US006257035B1

(12) United States Patent
Marks et al.

(10) Patent No.: US 6,257,035 B1
(45) Date of Patent: Jul. 10, 2001

(54) COMPRESSIVE HYDROFORMING

(75) Inventors: Larry D. Marks, Woodstock; Thomas L. Bestard, Belmount; Gerrald A. Klages, Woodstock, all of (CA)

(73) Assignee: TI Corporate Services Limited, London (GB)

( * ) Notice: Subject to any disclaimer, the term of this patent is extended or adjusted under 35 U.S.C. 154(b) by 0 days.

(21) Appl. No.: 09/461,189

(22) Filed: Dec. 15, 1999

(51) Int. Cl.[7] ..... B21D 26/02
(52) U.S. Cl. ..... 72/57; 72/58; 72/55
(58) Field of Search ..... 72/57, 58, 61, 72/62, 55

(56) References Cited

U.S. PATENT DOCUMENTS

Re. 33,990 * 7/1992 Cudini ..... 72/367
5,070,717 * 12/1991 Boyd et al. ..... 72/57
5,974,846 * 11/1999 Ash ..... 72/55

FOREIGN PATENT DOCUMENTS

385146 * 3/1965 (CH) ..... 72/57
45-1344 * 1/1970 (JP) ..... 72/57
153909 * 1/1963 (SU) ..... 72/57

* cited by examiner

*Primary Examiner*—David Jones
(74) *Attorney, Agent, or Firm*—Rideout & Maybee

(57) ABSTRACT

Forming a tubular workpiece by applying fluid pressure to the interior of the workpiece and enclosing the pressurized workpiece in a die that has a die cavity. A portion or the whole of the die cavity has its internal periphery smaller than the external periphery of the workpiece. This subjects the workpiece to compressive forming.

15 Claims, 2 Drawing Sheets

COMPRESSIVE HYDROFORMING

The present invention relates to a method for hydroforming a tubular workpiece. Currently, hydroforming is used on a large scale for manufacture of frame components for road vehicles. The hydroforming process has application in other manufacturing and industrial processes where a tubular product formed to very precise dimensions and possessing properties of strength and lightness is desired, for example in the aerospace industry and furniture manufacturing.

In the course of hydroforming, a tubular workpiece is confined within a die cavity formed by dies within a press, and the workpiece is pressurized internally, usually with a pressurized liquid, for example, water. For example, the pressurization may be about 28 to 250 MPa, depending on the nature of the part that is being hydroformed. The internal pressurization causes the tube workpiece to conform to the interior of the die cavity. Advantageously, the tubular workpiece is pre-pressurized, typically to about 3 to 20 MPa depending on the part, before the press is operated to close the dies together and completely confine the workpiece in the die cavity. Pre-pressurization allows the workpiece to be confined in a die cavity that is not excessively large in comparison to the external dimensions of the tubular workpiece without pinching of the blank occurring when the die sections are closed together. Commonly assigned U.S. Pat. No. Re. 33990 (Cudini) dated Jul. 14, 1992, for example, discloses hydroforming within a cavity the circumference of which is the same as or somewhat greater than the tubular workpiece such that forming the workpiece to the shape of the die cavity causes zero expansion or expansion of the circumference of the workpiece by no more than about 5%. The procedure of expanding the tube workpiece 0 to 5% has numerous advantages over procedures in which higher expansion ratios are employed. For example, punching of holes through the side wall of the hydroformed workpiece while pressurized within the forming die is facilitated. Further, dimensional stability, that is, part to part repeatability of dimensions is improved, and products with sharper corners, having a smaller ratio of the radius of cross-sectional curvature to the wall thickness are possible. Moreover, the yield strength of the product is improved to some extent.

Nevertheless, with known procedures, problems of leakage of the pressurized liquid during the course of hole punching may still occur, especially when holes of large width are formed. Further, the dimensional stability, yield strength and the cross-sectional sharpness of the corners that can be created are still not as great as may be considered desirable.

The present invention provides a method of forming a tubular workpiece wherein fluid pressure is applied to the interior of the workpiece before enclosing the pressurized workpiece in a die that has a die cavity having an internal periphery that is smaller than the external periphery of the workpiece, whereby the workpiece is subjected to compressive forming. The die is then opened and the compressively formed workpiece is removed.

In the present method, by making the cavity smaller than the tube workpiece, and effecting compressive forming of the workpiece, the material of the tube wall is pushed against the punch during procedures of piercing the wall of the workpiece, and this avoids problems of leakage when large width holes are punched in the workpiece while confined in the die. Further, the compressive force that is applied to the tube wall of the workpiece produces a very high degree of dimensional stability, provides improved yield strength, and allows very sharp cross-sectional corners to be formed. The compression forces acting on the material of the tube wall push the material of the tube wall into areas, such as very sharp corners, into which it would not normally flow.

BRIEF DESCRIPTION OF THE DRAWINGS

Preferred embodiments of the invention will now be described with reference to the drawings.

Referring to the drawings, FIG. 1 shows in cross-section a portion of an upper die 11 and of a lower die 12 having die cavities 13 and 14, respectively, and mating surface portions 16 and 17, respectively. In the closed position of the die sections 11 and 12, as seen in FIG. 2, the mating surface portions 16 and 17 mate together, while the cavity portions 13 and 14 form a closed die cavity 18.

Figure 3:
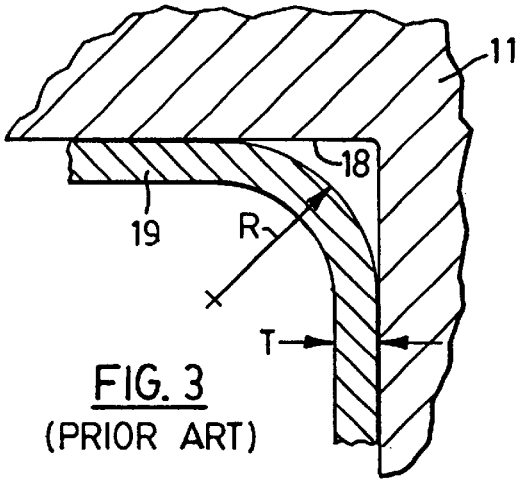
FIG. 3 (PRIOR ART)
FIG. 3 is a partially fragmentary cross-sectional view showing a corner of a tube workpiece that can be formed in accordance with prior art procedures.

In the preferred form of the hydroforming method, a tubular workpiece 19 which may initially be of, for example, a circular or elliptical cross-section is placed between the die section 11 and 12 while they are in an open condition wherein the mating surfaces 16 and 17 are separated sufficiently to allow the workpiece 19 to be introduced between the die sections 11 and 12. Preferably, the die sections 11 and 12 are moved to a partially closed position in which internal surfaces of the die cavities 13 and 14 lightly grip the workpiece 19. The opposite ends of the workpiece are then engaged with sealing apparatus through which a pressurized liquid 21, usually water, is introduced in order to fill the interior of the tube workpiece 19. After sealing, the liquid inside the workpiece is then preferably pressurized to a desired pre-pressure that will avoid undesired deformation of the tube workpiece 19 when the die sections 11 and 12 are closed together. Such undesired deformation may be, for example, crumpling or corrugation of the wall of the workpiece 19 that cannot subsequently be removed by internal pressurization, or pinching of portions of the sidewall of the workpiece 19 between the mating surface portions 16 and 17 of the die sections 11 and 12 when the die sections 11 and 12 are closed together.

Figure 2:
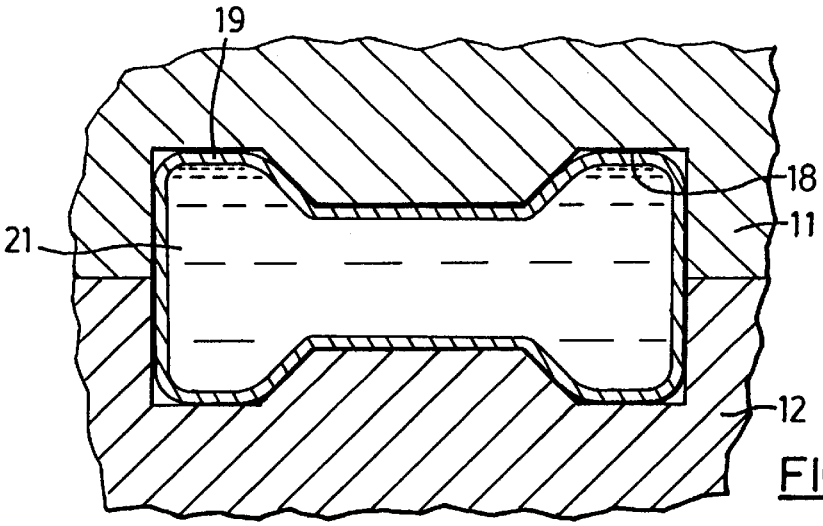
FIG. 2 shows the part undergoing hydroforming in a completely closed die.

The die sections 11 and 12 are closed together, so that the mating surface portions 16 and 17 meet as shown in FIG. 2 and the tube workpiece 19 is confined in the closed die cavity 18, as seen in FIG. 2. Usually, the pressure within the tube workpiece 19 is then increased and maintained such that the stress to which the wall is subjected is less than or greater than the yield strength of the material. The pressure required is that necessary to force the wall of the tube workpiece 19 to conform to the interior of the die cavity 18.

Holes may be punched through the tube wall once the tube workpiece has been formed to the desired cross-section. The internal pressure is then relieved, the tube drained, the die sections 11 and 12 opened and the formed tube workpiece 19 removed from the die.

A new tube workpiece may then be placed between the open die sections, and the above cycle of operation repeated.

The techniques, procedures, pressures and apparatus required to successfully perform the hydroforming procedures as above described are well known to those of ordinary skill in the art and need not be described in detail here. Examples of techniques, procedures, pressures and apparatus that may be used for prepressurization, tube end sealing, hole forming and in other aspects of the hydroforming process are described in a number of commonly assigned U.S. patents, including the above mentioned U.S. Pat. No. Re. 33990, U.S. Pat. No. 4,989,482 dated Feb. 5, 1991 (Mason), U.S. Pat. No. 5,235,836 dated Aug. 17, 1993 (Klages et al), U.S. Pat. No. 5,644,829 dated Jul. 8, 1997 (Mason et al), U.S. Pat. No. 5,445,002 dated Aug. 29, 1995 (Cudini et al) and in U.S. patent application Ser. No. 09/249,764 filed Feb. 16, 1999 in the name Morphy et al, and Ser. No. 09/361,998 filed Jul. 28, 1999 in the name Klages et al. The disclosures of all these patents and applications are hereby incorporated by reference.

In the present invention, the hydroforming technique described above is modified in that the periphery of the die cavity 18 is smaller than the external periphery of the tube workpiece 19, so that the material of the wall of the tube workpiece 19 is subjected to compression when the die sections 11 and 12 close together. While it is contemplated that in some forms of the present invention, the workpiece 19 may be subjected to compression along the whole of its length, in the preferred form, the periphery of the die cavity 18 is smaller than the workpiece 19 along a portion or portions of the length of the workpiece 19. Such portion or portions may be, for example, a portion that may be of varying cross-sectional shape or of uniform cross-sectional shape along its length. The portion may be, for example, a portion in which one or more holes may be formed through the tube wall, or in which, as seen in cross-section, an external or internal corner is to be formed, preferably a tightly radiused corner. Further, such portion may be a portion of the product that is to be subjected to unusually high stress in service, or where it is desired to have exceptionally good dimensional stability between successively formed products. Such portion may, for example, occupy, or such portions in aggregate may, for example, occupy about 1 to about 50%, more preferably about 5 to about 40%, and still more preferably about 5 to about 20% of the length of the tube product.

The above procedure provides a number of advantages. For example, with known procedures in which the periphery of the die cavity 18 is zero to about 5% greater than the periphery of the original tube workpiece 19, it is difficult to form the workpiece 19 with sharp corners. As seen on a somewhat enlarged scale in a corner area as shown in FIG. 3, in the absence of compressive forming as conducted in accordance with the present invention, the sharpest corner that may be formed within the die cavity 18 is such that the radius of curvature R is at least about 1.8T, wherein T is the thickness of the wall of the tube workpiece 19. Regardless of the pressured applied within the tube workpiece 19, the material of the tube wall 19 engages on the side walls of the die cavity 18 on either side of the corner and a sharp radius corner cannot be achieved. With the present invention, wherein the wall 19 is compressively formed significantly sharper corners can be achieved, for example in the range of about 2.5 to 0.5 T, more preferably less than about 2.0 T and more preferably less than about 1.7 T, and most preferably less than about 1.5 T. The sharper corners confer significant advantages such as increased rigidity in the finished part and allow greater freedom of choice in the design of the finished part, allowing the shape to be tailored to meet particular applications.

Further, greatly improved dimensional stability is achieved, that is parts produced in successive hydroformings in the same die tend to have similar or identical dimensions, so that the part to part repeatability of dimensions is improved, and the yield strength of the finished part can be increased as compared to like parts that are not compressively formed.

Figure 5:
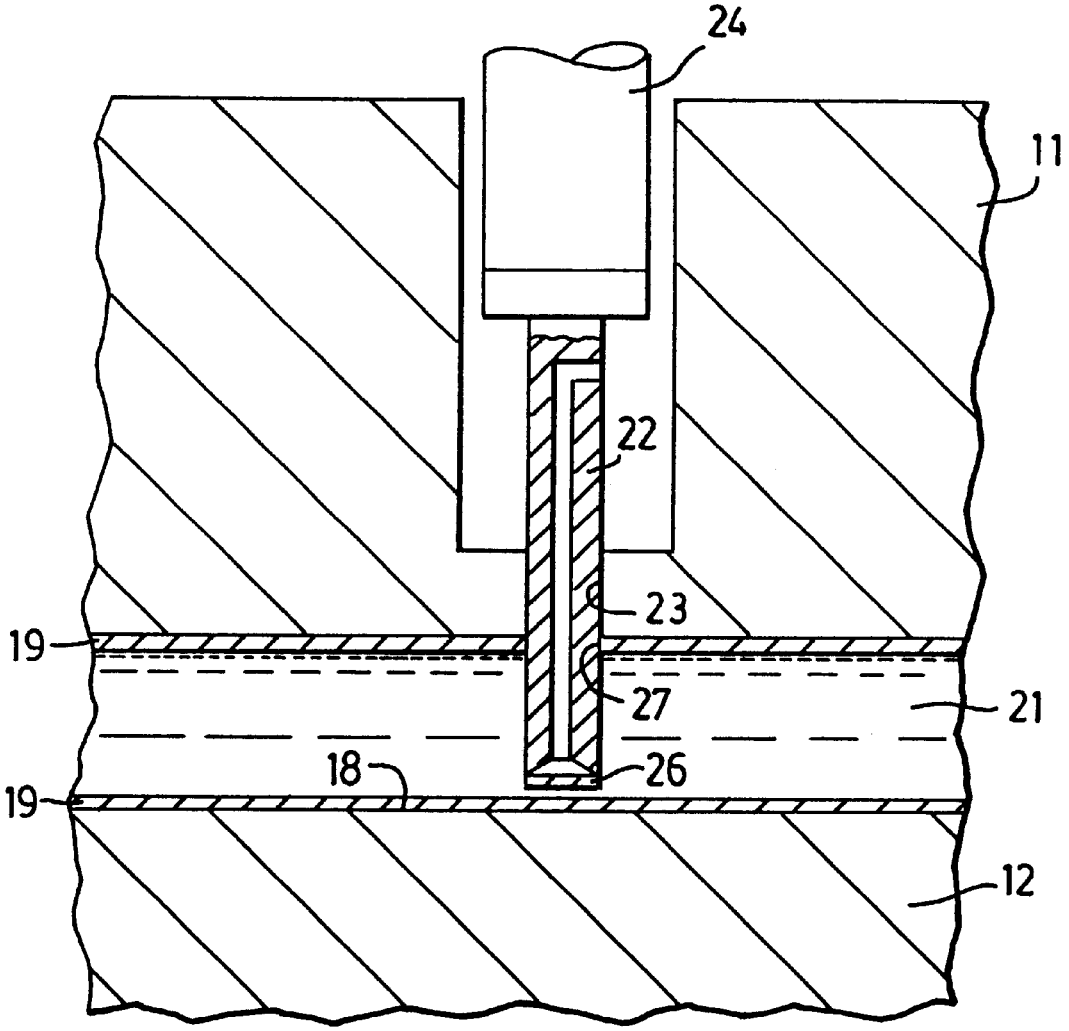
FIG. 5 is a partially fragmentary cross-sectional view showing punching a hole through a wall of a tube workpiece.

A further significant advantage of the compressive forming procedure in accordance with the present invention is that it facilitates the formation of holes through the wall of the tube workpiece 19, at least in a portion of the workpiece that is compressively formed. Desirably, holes are formed through the side wall of the workpiece while it is internally pressurized within the closed die cavity, for example as seen in FIG. 5. Usually, punches 22 are incorporated in the structure of the die sections 11 and 12. The punches occupy bores or passageways 23 that communicate with the die cavity 18 and normally are disposed generally transversely with respect to the longitudinal tubular axis. The punches reciprocate in these bores under the control of punch driving means, for example pressure cylinder and piston arrangements 24, mounted on or adjacent the die sections 11 and 12, so that a punch 22 may be, for example as seen in FIG. 5, advanced to extend into the die cavity 18 and puncture the side wall of the tube workpiece 19 and shear out a slug 26 therefrom and create an opening 27 in the side wall of the workpiece 19. The procedures and apparatus used for punching out openings in the tube workpiece are in themselves well known to those skilled in the art, and need not be described in detail herein. Examples of apparatus and punching procedures are described, for example, U.S. Pat. No. 4,989,482 and patent application Ser. No. 09/361,764 mentioned above.

Often, in order to accommodate components employed in association with the finished tubular part in an automobile or other frame it is desired to provide relatively wide openings in the wall of the tubular workpiece 19 and, accordingly, to use relatively wide punches to form the openings. When the punch is relatively wide, for example is a considerable percentage of the cross-sectional width of the finished part, the hole formed by the punch weakens the part. The part may then tend to deform or expand under the internal pressure with the result that contact is lost between the border of the hole and the side of the punch. This results in leakage of fluid from inside the workpiece 19 such that there is depressurization within the workpiece 19. These problems of depressurization tend to be encountered to a greater extent when the width of the punch, and hence of the hole thereby formed, is more than about 15% the cross-sectional width of the finished part as measured in the direction transversely of the punched hole and are still more acute when this width is more than about 25% or, especially, more than about 50% the said cross-sectional width. The width may be, for example up to about 95% of the said cross-sectional width, more usually no more than about 90% the said cross-sectional width. Loss of pressurization within the tube workpiece 19 leads to difficulties in processing of the workpiece 19. For example, usually, successful punching depends on pressurization being maintained within the tubular part. Frequently, a die will be equipped with a multiplicity of punches since it will often be desired to form a number of holes in each hydroformed part. For various reasons, the punches do not usually operate precisely simultaneously. For example, the cylinders that drive the punches may be of different sizes, and there may be discrepancies in the lengths of the conduits that convey the operating pressure pulses from the pressure generator to the various pressure cylinders. If operation of one punch results in loss of pressurization, a punch that extends later toward the part may achieve only imperfect punching or may fail to punch a hole at all, since there is no longer fluid pressure within the part to hold the wall of the workpiece pressed outwardly, and to cause the punch to shear crisply through the outwardly pressed wall. With the present invention, wherein the side wall of the tube workpiece 19 is compressively formed, in the region of the compressive forming it is found that leakage and loss of pressurization are significantly reduced or are eliminated altogether even when punches with relatively large width dimensions, such as those mentioned above, are employed. It has been found that the compressive forming tends to push the material of the tube wall against the side of the punch during piercing of the wall of the workpiece and eliminates leakage or reduces leakage to an extent such that the supply of pressurized liquid that maintains pressurization in the tube is capable of replenishing the liquid so that there is insignificant loss of pressurization.

In the preferred form, in carrying out the present method, in the event that the dimensions of the workpiece are subject to manufacturer's tolerances, regard should be paid to the manufacturer's tolerances of the starting material. That is to say, the internal periphery of the die cavity 18 should be sized so that the desired compression is achieved even where the actual external periphery of the starting material blank 19 is less than nominal and is at the manufacturer's minimum tolerance. Usually, however, these tolerances are relatively small. In the present specification and in the appended claims, by "the external periphery" of a workpiece is meant the external periphery of that workpiece taking into account the minimum manufacturer's tolerance, that is to say the smallest size that exists in the range of sizes defined by the manufacturer's tolerances. To take a concrete example, for the avoidance of doubt, a manufacturer may provide a substantially perfectly circular cross-section tube that is 2.000 inches (50.8 mm) in diameter±(plus or minus) 5 thousandths of an inch (0.127 mm). The maximum diameter is 2.005 (50.927 mm) and the minimum is 1.995 (50.673 mm) inches. By multiplying by the numerical value of the Greek symbol pi, the maximum periphery is calculated as 6.300 inches (160.0 mm) and the minimum is 6.268 (159.2 mm). In such case, "the external periphery" of this workpiece is considered to be 6.268 inches (159.2 mm) and the internal periphery of the die cavity 18 is made smaller than 6.268 inches (159.2 mm).

It may be noted that in known procedures, the die cavity has had its periphery at least as great as the workpiece taking into account the manufacturer's maximum tolerances.

In the method of the present invention, preferably the die cavity 18 has its internal periphery at least about 0.1% smaller than the external periphery of the workpiece, (all percentages except where otherwise indicated being based on the external periphery of the workpiece). If the difference between the internal periphery of the die cavity and the external periphery of the workpiece is less than about 0.1%, it is found that there is insufficient compressive force applied to the tube workpiece, with the result that it may be difficult or impossible to provide sharply radiused corners on the workpiece or to significantly reduce or avoid leakage of liquid from the interior of the workpiece when holes are punched therein, and a desired degree of dimensional stability, or a desired degree of increased yield strength, may not be achieved. Preferably, the internal periphery of the die cavity is not more than about 10% smaller than the external periphery of the workpiece. The use of die cavities that are more than about 10% smaller than the external periphery of the workpiece does not appear to achieve superior results and may tend to crush the workpiece and produce wrinkles in it parallel to the center line of the tube.

More preferably, the internal periphery of the die cavity 18 is up to about 5% smaller, still more preferably up to about 3% smaller than the external periphery of the workpiece, and most preferably about 0.1% to about 1% smaller than the external periphery of the workpiece.

In order to achieve compression and die closure, press closing forces somewhat greater than those usually employed in the press may be needed to effect closure of the press. The required forces can be readily determined in any given case by simple trial and experiment.

While the above detailed description taken together with the accompanying drawings provides ample information to allow one of ordinary skill in the art to conduct the present method, for the avoidance of doubt, a detailed example will be provided.

EXAMPLE

Figure 4:
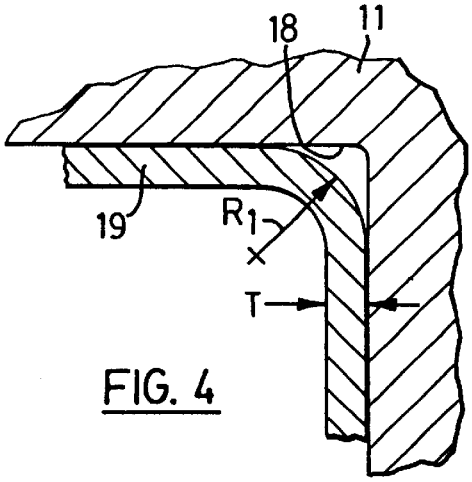
FIG. 4 is a partially fragmentary cross-sectional view showing a sharp corner formed in accordance with the procedures of the invention.
Figure 1:
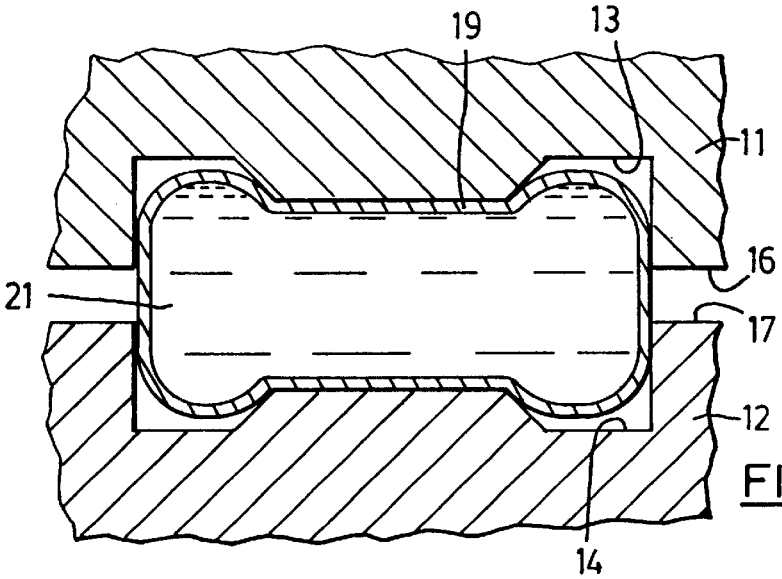
FIG. 1 shows somewhat schematically a cross-section illustrating a pressurized tubular component positioned between partially closed die sections.

An HSLA 345 MPA steel tube having a nominal wall thickness of 1.5 mm and a nominal diameter of 50.8 mm (manufacturer's tolerance plus or minus 0.006 inches (0.15 mm)) is subjected to compressive hydroforming in the manner described above in detail in connection with FIGS. 1, 2 and 4.

In the course of hydroforming, the tube is prepressurized to an internal pressure of 7 MPA.

The internal periphery of the die cavity 18 is 158.0 mm (0.7% smaller than the external periphery of the workpiece). After die closure, the internal pressurization was increased to 42 MPA.

The die cavity 18 included a sharp corner and the workpiece is provided with a sharp corner having a radius of 3 mm (2 T, where T is the thickness of the wall of the workpiece).

What is claimed is:

1. Method of forming a tubular product from a tubular workpiece having an external periphery, comprising:

(a) providing a tubular workpiece having an external periphery;

(b) providing a die defined by die sections having open and closed positions, said die sections having mating surfaces not in contact in the open position and that mate together in the closed position to define a closed die cavity at least a portion of which has an internal periphery smaller than said external periphery of the workpiece prior to being deformed by said die;

(c) placing the workpiece between the die sections in the open position;

(d) moving the die sections to the closed position to compressively form said workpiece to said tubular product, and including the steps of filling the workpiece with liquid and applying liquid pressure to the interior of the workpiece before said die sections move to the closed position;

(e) reducing the liquid pressure within the product; and (f) moving the die sections to the open position and removing the product therefrom.

2. Method as claimed in claim 1 wherein in said step of providing a die, said internal periphery is about 0.1% to about 10% smaller than the external periphery.

3. Method as claimed in claim 2 wherein said internal periphery is up to about 5% smaller than the external periphery.

4. Method as claimed in claim 2 wherein said internal periphery is up to about 3% smaller than the external periphery.

5. Method as claimed in claim 2 wherein said internal periphery is about 0.1% to about 1% smaller than the external periphery.

6. Method as claimed in claim 1, including increasing the liquid pressure within the workpiece after said die sections move to the closed position.

7. Method as claimed in claim 1 wherein in said step of providing a die, in cross section transverse to a longitudinal axis of the workpiece, said die cavity comprises at least one corner and said tubular product is thereby provided with a corner.

8. Method as claimed in claim 7 wherein said workpiece has a wall thickness and said corner has a radius of curvature and said radius of curvature is about 2.5 to about 0.5 times said wall thickness.

9. Method as claimed in claim 8 wherein said radius of curvature is less than about 2.0 times said wall thickness.

10. Method as claimed in claim 8 wherein said radius of curvature is less than about 1.7 times said wall thickness.

11. Method as claimed in claim 10 wherein said radius of curvature is less than about 1.5 times said wall thickness.

12. Method as claimed in claim 1 including the step of forming at least one hole through the side wall of the product while internally pressurized within the die cavity by passing at least one punch through said side wall.

13. Method as claimed in claim 12 wherein said punch has a width dimension more than about 15% the cross-sectional width of the compressively formed product.

14. Method as claimed in claim 13 wherein said width is more than 25% said cross-sectional width.

15. Method as claimed in claim 13 wherein said width is more than about 50% said cross-sectional width.

* * * * *